United States Patent [19]

Shoemaker

[11] Patent Number: 4,903,874

[45] Date of Patent: Feb. 27, 1990

[54] SHOULDER HOLSTER

[76] Inventor: Randy R. Shoemaker, 4819 St. Andres, LaVerne, Calif. 91750

[21] Appl. No.: 254,039

[22] Filed: Oct. 6, 1988

[51] Int. Cl.[4] ..... F41C 33/02

[52] U.S. Cl. ..... 224/206; 224/209; 224/258; 224/260; 224/264; 224/901; 224/911; 2/327; 2/DIG. 6

[58] Field of Search ..... 224/192, 206, 208, 215, 224/216, 258, 260, 264, 266, 901, 914, 149, 184, 203, 209, 259; 2/326, 327, 328, DIG. 6; 24/306, 442

[56] References Cited

U.S. PATENT DOCUMENTS

| | | | |
|---|---|---|---|
| 2,620,479 | 12/1952 | Buck | 224/202 X |
| 3,901,579 | 8/1975 | Demerest | 350/98 |
| 4,346,827 | 8/1982 | Bianchi et al. | 224/206 |
| 4,580,707 | 4/1986 | Shoemaker | 224/206 |
| 4,637,535 | 1/1987 | Aleman | 224/202 |
| 4,721,238 | 1/1988 | Shoemaker | 224/243 |

*Primary Examiner*—Henry J. Recla
*Assistant Examiner*—R. M. Fetsuga
*Attorney, Agent, or Firm*—Boniard I. Brown

[57] ABSTRACT

A shoulder holster having right and left hand pairs of front and rear shoulder straps, rear neck and back straps joining the rear shoulder straps, upper fasteners joining the upper ends of each pair of straps, a handgun sheath or holder secured to the lower ends of one pair of shoulder straps, and lower fasteners joining the lower ends of the other pair of shoulder straps. The holster is worn with the shoulder straps extending over the wearer's shoulders to support the gun holder beneath one armpit of the wearer and position the lower ends of the other shoulder straps beneath the wearer's other armpit for holding handcuffs, if desired. The upper fasteners joining the upper shoulder strap ends, which preferably are Velcro fasteners, are releasible and adjustable to accommodate a range of wearer shoulder sizes.

2 Claims, 1 Drawing Sheet

SHOULDER HOLSTER

BACKGROUND OF THE INVENTION

1. Field of the Invention

This invention relates generally to handgun holsters and more particularly to an improved shoulder holster.

2. Prior Art

Law enforcement officers, security personnel, and other persons authorized to carry concealed handguns when wearing plain clothes generally wear shoulder holsters for holding the guns. Among the requisites of a shoulder holster are these. A shoulder holster must permit quick and easy access to the gun so that it may be quickly drawn when neccessary. The holster and its contained handgun must be unobstrusive and not create any revealing bulges or the like when worn under outerwear such as a suit coat. The holster must hold a handgun very securely so that the gun will not be accidentally dislodged from the holster during strenuous activity of the wearer, such as during a chase or a scuffle. The holster should also be comfortable to wear.

A great variety of shoulder holsters have been devised. Examples of prior shoulder holsters are disclosed in U.S. Pat. No. 4,721,238 and in the patents cited therein. While shoulder holsters vary substantially in overall design and construction, they are generally characterized by a sheath or holder for receiving the handgun to be carried and straps for supporting the gun holder on the wearer's body in a position just below one armpit of the wearer in a manner such that the gun is situated between his corresponding upper arm and the adjacent side of his body.

One of the problems associated with the design of such a shoulder holster involves accommodating the holster to a range of wearer body sizes. The present invention addresses this problem and provides an improved shoulder holster which is adjustable in a unique way to accommodate a range of wearer body sizes.

SUMMARY OF THE INVENTION

This invention provides an improved shoulder holster which is uniquely constructed and arranged to accommodate a range of wearer shoulder widths. The improved holster includes two pairs of front and rear shoulder straps having upper and lower ends. The two rear shoulder straps are joined by strap means which extend across the wearer's back. In the preferred embodiment on the invention, these strap means comprise a neck strap joining the upper ends of the two rear shoulder straps and a back strap joining the rear shoulder straps between their ends. The upper ends of each pair of front and rear shoulder straps are joined by upper strap joining means. A handgun sheath or holder is joined to the lower ends of one pair of shoulder straps. The lower ends of the other pair of front and rear shoulder straps are joined, preferably by lower strap fastening means which preferably permit adjustment of the strap length between the upper strap ends and the lower engaged fastening means.

The two pairs of front and rear shoulder straps, joined at their lower ends in one case by the gun sheath or holder and in the other case by the lower strap fastening means, form strap loops. The holster is worn with the wearer's shoulders disposed within these strap loops in such a way that the joined upper ends of the front and rear shoulder straps are positioned over the shoulders, and the gun holder hangs in a concealed position beneath one armpit of the wearer between the wearer's corresponding upper arm and the adjacent side of his body. The joined lower ends of the shoulder straps at the opposite side of the wearer's body hang beneath his other armpit and may be used to support handcuffs in a concealed position between his other upper arm and the adjacent side of his body. The neck strap of the holster extends across the back of the wearer at the base of his neck, and the back strap extends across the wearer's back approximately between his shoulder blades.

Accordingly to a primary feature of the invention, the upper shoulder strap joining means which join the upper ends of at least one pair, and preferably each pair, of front and rear shoulder straps are adjustable to permit relative adjustment of the respective upper strap ends edgewise of the strap ends to accommodate a range of wearer body sizes and particularly a range of wearer shoulder widths. In the preferred embodiment of the improved shoulder holster, the upper shoulder strap joining means comprise mating VELCRO fastening pads secured to the upper strap ends to permit relative adjustment of the corresponding upper shoulder strap ends in any lateral and endwise direction of the straps in such a manner as to accommodate a range of wearer shoulder widths and other body dimensions. This adjustment also enables the elimination and prevention of wrinkles in the neck and back straps of the holster, which can create unsightly bulges in the back of the wearer's coat, revealing the presence of the shoulder holster.

DESCRIPTION OF THE PREFERRED EMBODIMENT

Figure 1:
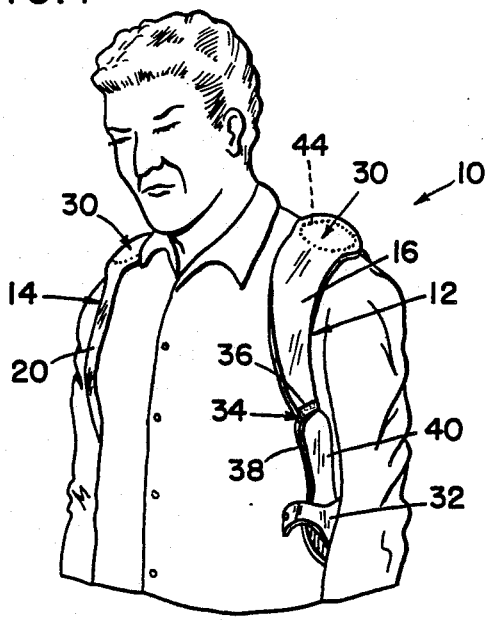
FIG. 1 illustrates a presently preferred shoulder holster according to the invention as it appears from the front of a wearer.
Figure 2:
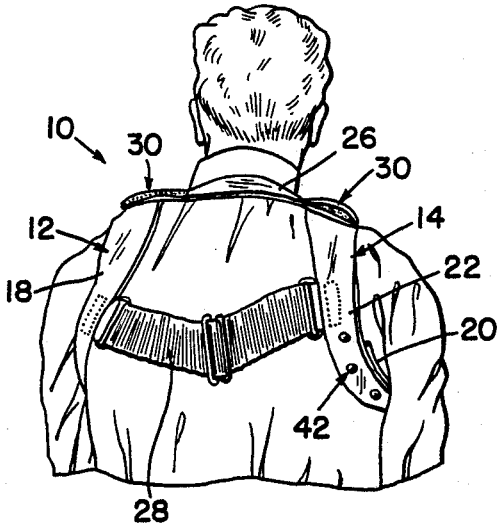
FIG. 2 illustrates the holster as it appears from the rear of the wearer.
Figure 3:
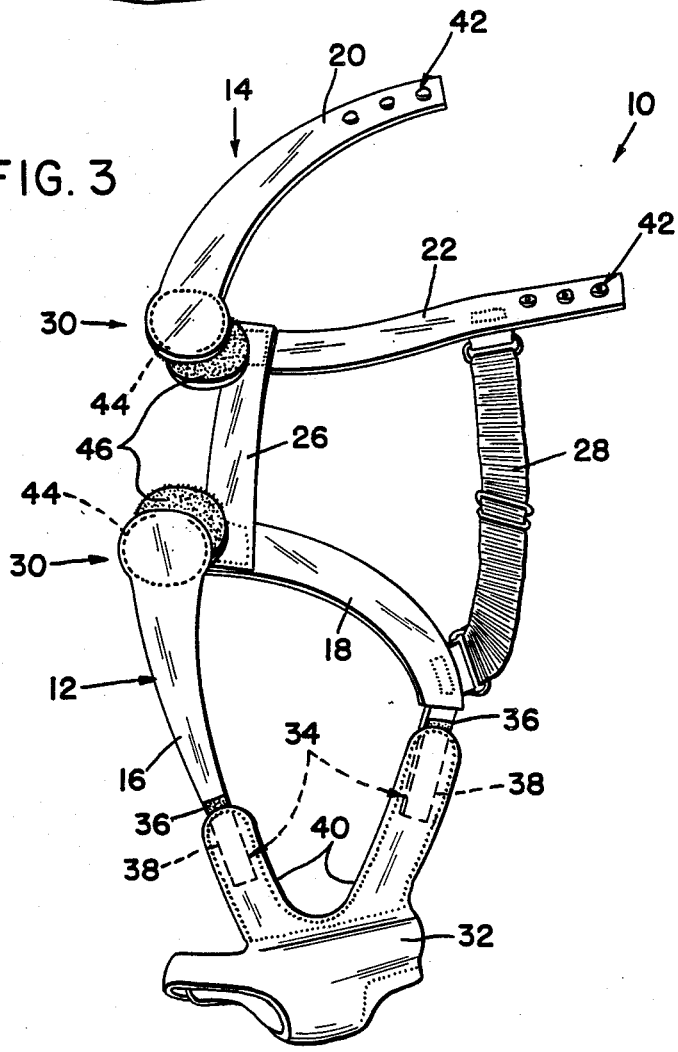
FIG. 3 is an enlarged view of the holster when laid out flat.

Referring first to FIG. 3 of the drawings, the improved shoulder holster 10 of the invention comprises a left hand pair 12 and a right hand pair 14 of shoulder straps. In this description, the expressions "left hand" and "right hand" refer to the wearer's left hand and right hand sides. The left hand pair 12 of shoulder straps includes a front shoulder strap 16 and a rear shoulder strap 18. The right hand pair 14 of shoulder straps includes a front shoulder strap 20 and a rear shoulder strap 22.

The two rear shoulder straps 18, 22 are joined by strap means 30. In the preferred shoulder holster illustrated, the strap means 30 comprises a neck strap 26 and a back strap 28. The neck strap 26 joins the upper ends of the rear shoulder straps 18, 22. The back strap 28 joins the two rear shoulder straps between their ends. In the illustrated preferred embodiment of the shoulder holster, the neck strap 26 is a relatively non-stretchable strap of fixed length. The back strap 26 is an elastic strap of adjustable length.

The upper ends of each pair 12, 14 of shoulder straps are joined by upper strap joining means 30. As will be explained presently, the upper strap joining means 30 are releasible and adjustable in a manner which permits relative adjustment of the upper ends of each pair of front and rear shoulder straps edgewise of the respective strap ends to accommodated the shoulder holster to a range of wearer body sizes, particularly shoulder widths. A sheath or holder 32 for receiving a handgun is secured to the lower ends of one pair 12 or 14 of the front and rear shoulder straps. The particular shoulder holster illustrated is for use by a right handed person, and for this reason, the gun holder 32 is secured to the lower ends of the left hand shoulder straps 16, 18. In a shoulder holster for use by a left handed person, the gun holder will be secured to the lower ends of the right hand shoulder straps 20,22.

The gun holder 32 is secured to the lower ends of the left hand shoulder straps 16, 18 by means 34. Preferably, the holder securing means 34 are releasible to permit removal and replacement of the holder and adjustable to permit some relative adjustment of the holder and the shoulder straps. The illustrated and preferred gun holder securing means 34 comprises mating VELCRO fastening pads 36, 38 fixed to the lower ends of the shoulder straps 16, 18 and to upper strap-like extensions 40 on the gun holder. These VELCRO pads provide secure attachment of the gun holder 32 to the shoulder straps 16, 18 while permitting easy removal and replacement of the holder as well as some degree of adjustment of the holder relative to and lengthwise of the shoulder straps.

The lower ends of the right hand shoulder straps 20, 22 have mating fastening means 42 for releasibly and adjustably joining these lower strap ends in a manner to adjust the effective length of the straps from their joined upper ends to the point at which the lower strap ends are joined. The particular fastening means 42 illustrated are snap fasteners or the like which are selectively engageable to adjust the effective strap length.

The left and right hand shoulder straps 16, 18 and 20, 22 joined as they are at their upper ends by the upper strap joining means 30 and at their lower ends by the gun holder 32 and the lower strap fasteners 42, respectively, form left and right hand shoulder strap loops. The improved shoulder holster 10 is worn with the wearer's shoulders positioned within these shoulder strap loops in such a way that the upper strap joining means 30 are located over the shoulders, and the gun holder 32 and the joined lower ends of the right hand shoulder straps 20, 22 hang beneath the wearer's arm pits between his upper arms and the sides of his body. The holster neck strap 26 extends across the wearer's back at the base of his neck and just below the level of his collar. The holster back strap 28 extends across the wearer's back approximately between his shoulder blades.

As noted earlier, the upper shoulder strap joining means 30 constitute an important feature of this invention. These upper strap joining means provide a holster adjustment to accommodate a range of wearer shoulder sizes. More specifically, the joining means 30 permit relative edgewise adjustment of the upper ends of each pair 12, 14 of shoulder straps both laterally and endwise of the respective straps. To this end, the preferred upper strap, joining means 30 comprise mating circular VELCRO hook and loop fastening pads or fasteners 44 and 46 secured to the upper ends of the shoulder straps 16, 18 and the upper ends of the shoulder straps 20, 22. These VELCRO fasteners permit adjustment of the upper ends of the front shoulder straps 16, 20 relative to the upper ends of their respective rear shoulder straps 18, 22 both fore and aft and sideways of the wearer in such a way as to fit the holster to the wearer regardless of his shoulder width. This adjustment of the holster is also effective to eliminate any wrinkle which may exist in the holster neck strap 26 due to an improper fit of the holster and would create an unsightly and revealing bulge in the back of the wearer's coat. The elastic holster back strap 28 is also adjustable to aid in fitting the holster to the wearer.

The gun holder 32 may comprise any type of holder for holding a handgun in a manner which secures the gun against being accidentally dislodged from the holder during strenuous activity of the wearer, such as during a chase, and yet permits the gun to be quickly and easily drawn from the holder when neccessary. The shoulder straps 20, 22 may be used to hold handcuffs in a concealed manner.

I claim:

1. A shoulder holster comprising:

right and left pairs of shoulder straps, each strap pair including a front shoulder strap and a separate rear shoulder strap having upper free ends and lower ends, strap means joining the two rear shoulder straps, a handgun holder, means securing said gun holder to the lower ends of the front and rear shoulder straps of one of said shoulder strap pairs, lower shoulder strap joining means joining the lower ends of the front and rear shoulder straps of the other shoulder strap pair, hook and loop fastening pads on the free upper ends, respectively, of the front and rear shoulder straps of each shoulder strap pair and releasably joining the upper shoulder strap ends of each shoulder strap pair, and wherein said shoulder holster is worn with the respective fastening pads engaged and positioned over the shoulders of the wearer, and said fastening pads are relatively adjustable laterally and rotatably to permit relative angular, lateral, and edgewise adjustment of the upper ends of the corresponding front and rear shoulder straps.

2. A shoulder holster according to claim 1 wherein:

said fastening pads comprise circular VELCRO pads.

* * * * *